United States Patent [19]

Leonhart

[11] 4,105,104

[45] Aug. 8, 1978

[54] COIN RELEASE DEVICE FOR COIN OPERATED GAMES

[76] Inventor: Franz Xaver Leonhart, 8381 Harburg near Pilsting, Ndb., Fed. Rep. of Germany

[21] Appl. No.: 784,351

[22] Filed: Apr. 4, 1977

[30] Foreign Application Priority Data

Apr. 23, 1976 [DE] Fed. Rep. of Germany ..... 2617806

[51] Int. Cl.[2] ..... G07F 5/04

[52] U.S. Cl. ..... 194/57

[58] Field of Search ..... 194/55, 57, 58, 78–81

[56] References Cited

U.S. PATENT DOCUMENTS 2,302,648 11/1942 Wiggins ..... 194/55 X 2,909,260 10/1959 Van Orden ..... 194/78

*Primary Examiner*—Stanley H. Tollberg

*Attorney, Agent, or Firm*—Brady, O'Boyle & Gates

[57] ABSTRACT

A longitudinally movable normally outwardly biased release rod is provided with a lateral projection having a coin receiving slot therein. A pivoted locking pawl is connected adjacent the release rod and normally engages the same to prevent inward movement. A second independently longitudinally displaceable rod connected adjacent the first release rod and carrying a U-shaped yoke, having a lateral projection which normally closes the bottom of the coin receiving slot such that a coin therein has its upper edge projecting into engagement with the U-shaped yoke, and a cam on the second rod adapted to raise the locking pawl when the release rod is moved inwardly and the coin moves the second rod inwardly, and a timing mechanism coupled to and actuated by the second rod and controlling the return stroke of the second rod and connected to release the second rod under influence of a return spring after an adjustable time period to the normal outward position to return the locking pawl to locking engagement with the first-mentioned release rod.

11 Claims, 7 Drawing Figures

COIN RELEASE DEVICE FOR COIN OPERATED GAMES

BACKGROUND OF THE INVENTION

1. Field of the Invention

The present invention relates to a coin release device for vending machines, such as coin operated games, which permits plural practice games for the same cost as contest games.

2. Description of the Prior Art

In pool billiards on a coin operated billiard table game, for example, the 15 balls required for the game are made available upon insertion of a coin and actuation of a release rod. However, according to the existing rules, the game is terminated as soon as the wrong ball falls into one of the holes. The remaining balls become unusable after a very short time and it is then only possible to obtain all the balls required to start a new game by inserting another coin in the coin release device controlling the game.

SUMMARY OF THE INVENTION

The object of the present invention is to provide a coin release or controller device for coin operated table ball games and the like which makes it possible to try out a number of practice plays of the game for the same cost as a contest game in which a plurality of balls often remain unused, without having to insert another coin.

According to the invention this problem is solved by using a coin release device comprising a release rod, whose blocking action is released by the insertion of a coin and which is displaced by means of an associated device and further comprising an independently displaceable second rod which is adjacent to the release rod and which includes a U-shaped yoke which encloses a lateral projection on the release rod and so grips a coin which falls into the continuous slot on the lateral projection that when the release rod is actuated, the upwardly projecting part of the coin forms a stop for the engagement of the U-shaped yoke, and further includes a cam whose beveled edge keeps the blocking pawl of the release rod in the raised position when the latter is actuated. The invention is characterized in that the second rod is equipped with a powerful return spring and a toothed rack which drives a retard mechanism effective only on the return path. For example, the retard mechanism may consist of a step-up gear which drives a pendulum of adjustable length.

If, for example, the length of the pendulum is so adjusted that the predetermined or preset playing time is 15 minutes, a plurality of practice games can be played during this time because it is possible to begin new games—each time with a full set of balls—by repeatedly pushing in the coin controller release rod until the delay mechanism has run down to thus block the furhter actuation or pushing in of the release rod.

In a modified form, a timing mechanism of the spring actuated type has a lever arm that is actuated by the second rod as it is moved inwardly to wind the timing mechanism, and the lever arm under the control of the timing mechanism and a return spring moves the second rod on its timed return path. While the second rod is moving along its return path the release rod can be repeatedly pushed in to set up the game device for a new game.

DESCRIPTION OF THE PREFERRED EMBODIMENT

Figure 1:
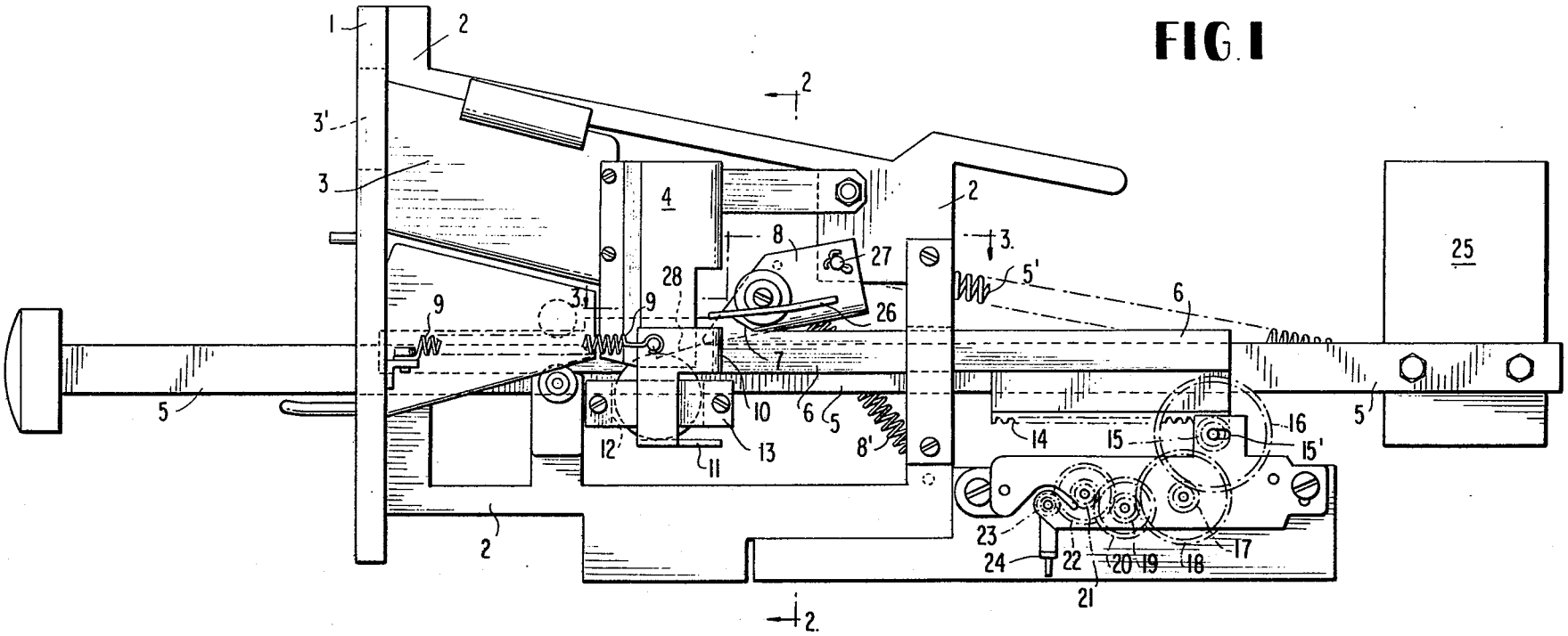
FIG. 1 is a side elevation view of the coin release device according to the invention showing the device in the inoperative or rest position.
Figure 3:
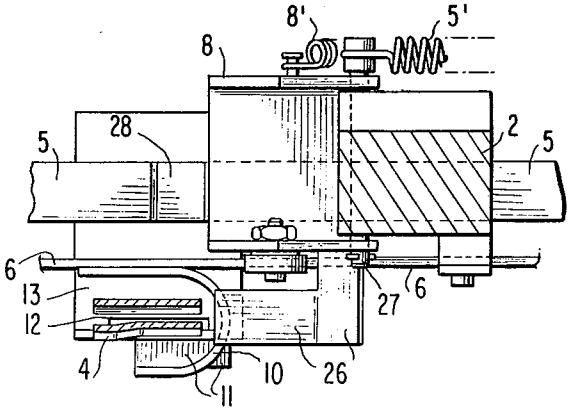
FIG. 3 is a fragmentary longitudinal sectional view taken substantially along the line 3—3 of FIG. 1.
Figure 2:
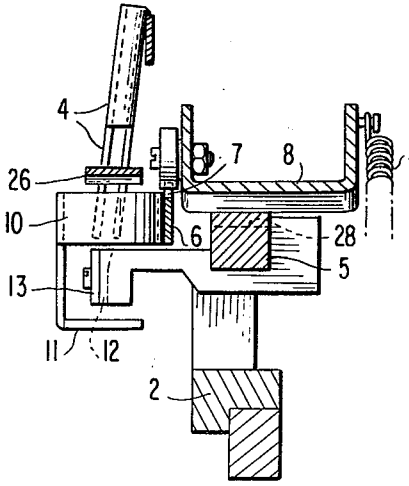
FIG. 2 is a fragmentary cross-sectioned view taken substantially along line 2–2g, FIG. 1.

The coin release device according to the invention comprises in a conventional manner a front plate 1, a cast aluminum frame 2 and a coin checker 3 into which coins of predetermined denoninations are inserted through a coin slot 3' in front plate 1. The coin checker 3 is conventional and well known in the art, comprising a coin shaft 4 and a longitudinally movable release rod 5 which is held in the normal outward position illustrated by means of a return spring 5'. Plate 25 connected for movement with rod 5 is adapted to actuate the game device to which the coin release device is connected to control.

Figure 4:
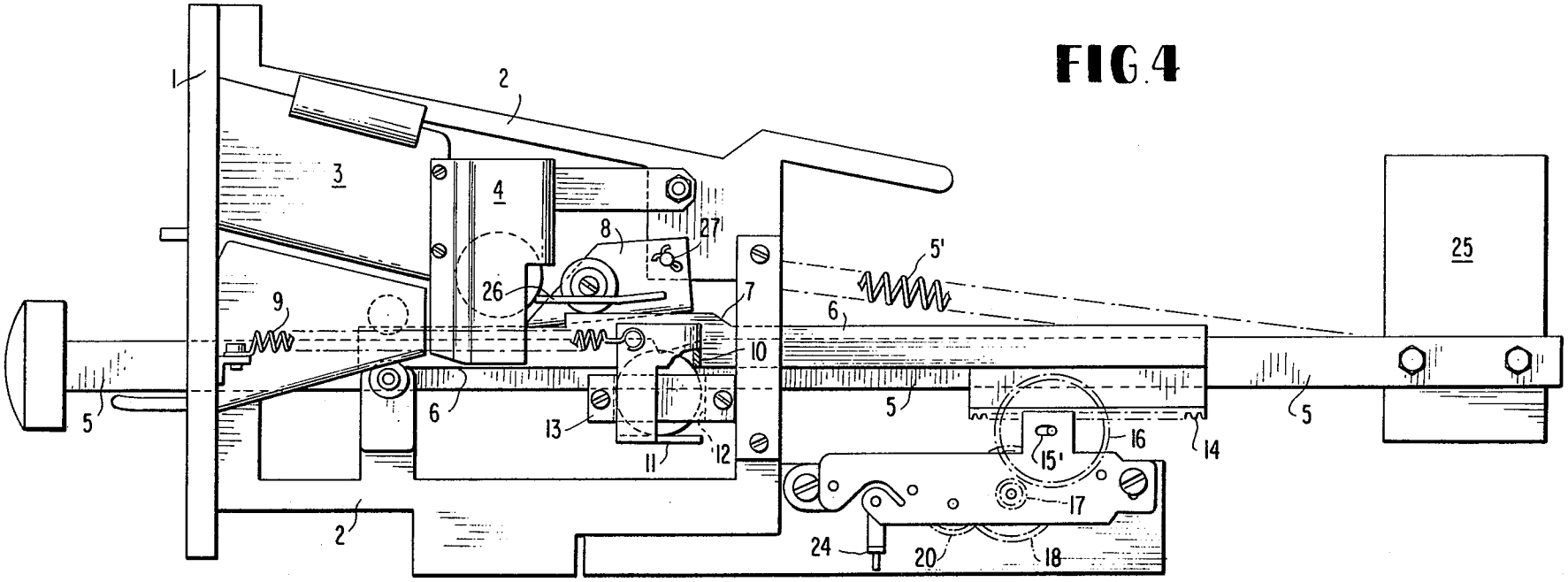
FIG. 4 is a view similar to FIG. 1 but showing the actuating release rod pushed inwardly to the actuating position and showing the coupling function of the coin.

A second longitudinally movable rod 6, whose cam 7 holds a locking pawl 8 in the horizontal release position, is disposed adjacent to the release rod 5. The locking pawl 8 is pivotally connected to frame 2. A side protruding U-shaped yoke 10 is connected to the second rod 6 and a powerful spring 9 is also connected to rod 6 and urges it into the normal forward position as shown in FIGS. 1 and 7. A lateral projection 11 of the U-shaped yoke 10 is situated beneath the slot 12 of the coin retainer shaft 13 projecting laterally from release rod 5, such that an inserted coin deposited in coin retainer shaft 13 from coin shaft 4 is retained in slot 12 and the upper end of the inserted coin projects into the U-shaped yoke 10 when the second rod 6 is in its normal position, as shown in FIG. 1. Accordingly when the release rod 5 is first actuated after insertion of a coin, the second rod 6 because of the inserted coin coupling, the coin shaft 13 and yoke 10, is also carried along with release rod 5 when it is pushed in, as shown in FIG. 4, and the locking pawl 8 is pivoted out of the locking notch 28 in rod 5 against the tension of its spring 8' into the release position by the cam 7 on second rod 6, so that the pawl 8 is moved out of its normal position locking release rod 5 from being pushed in, as shown in FIGS. 1 and 6. However, when the release rod 5 is drawn back to the outward position by the return spring 5' into the position indicated in FIG. 5, the coin in slot 12 falls free into a coin box, and the second rod 6 remains in the inward position, shown in FIG. 5, in spite of the pull of the return spring 9 owing to the fact that its toothed gear 14 is in engagement with a pinion 15 which, under the influence of a switching lever 23, is only capable of effecting an oscillating movement; the oscillation rate being adjusted by displacing a pendulum weight 24 with respect to its pivot axis. The pinion 15 is connected to the switching lever 23 through step-up gear train 16, 17, 18, 19, 20, 21 and 22, and the entire gear train functions as a retard mechanism that is effective only on the return stroke of second rod 6, since pinion 15 is mounted in a longitudinal slot 15' such that the gear train is only in mesh during the return stroke since spring 9 causes rod 6 to move slightly to the left in FIG. 5, causing gears 15 and 16 to move their shaft to the left in slot 15' to bring gear 16 into mesh with gear 17 and the rest of the gear train. The displacement of the pendulum weight adjusts the duration of the predetermined or preset playing time.

In contrast to the conventional coin release devices, in which, for example, a plate 25 attached to and movable with the release rod 5 actuates the game device when the release rod 5 is pushed in and only releases the balls required for a game on one occasion, in the case of a coin release device according to the present invention it is possible to play a number of games with the same coin during a predetermined time period by pushing in the release rod as many times as desired during the predetermined time period which causes the catch plate 25 to actuate the game so as to return all the balls, which have already been played, for a new game each time the release rod 5 is depressed or pushed in.

Figure 5:
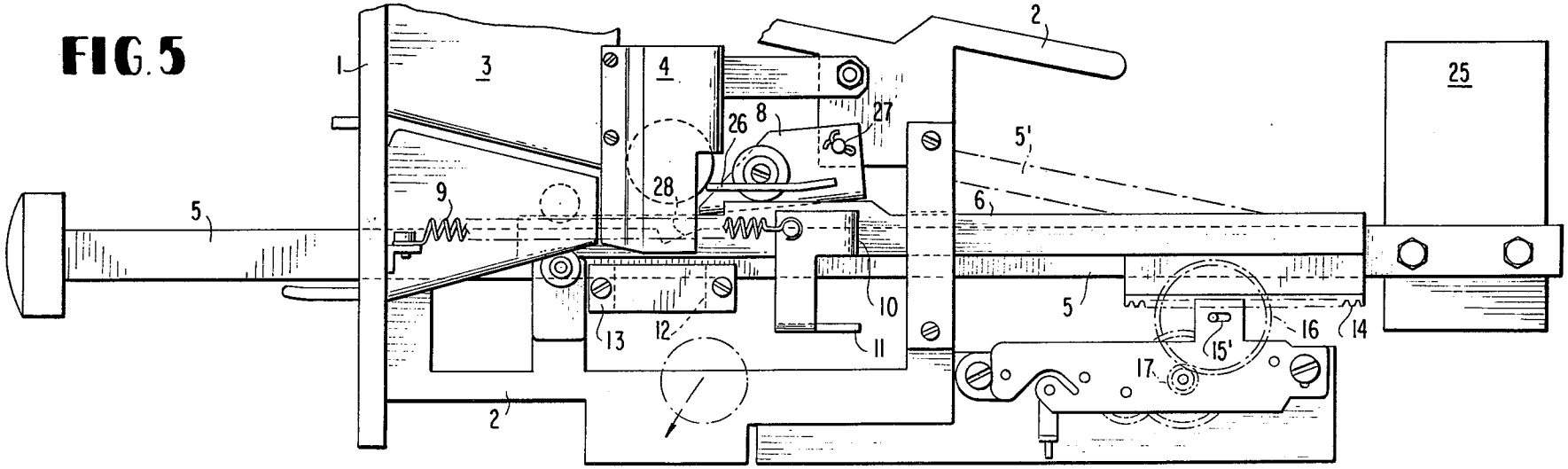
FIG. 5 is a side view showing the operating position of the components following the step shown in FIG. 4 with the release rod returned to its outward position.
Figure 6:
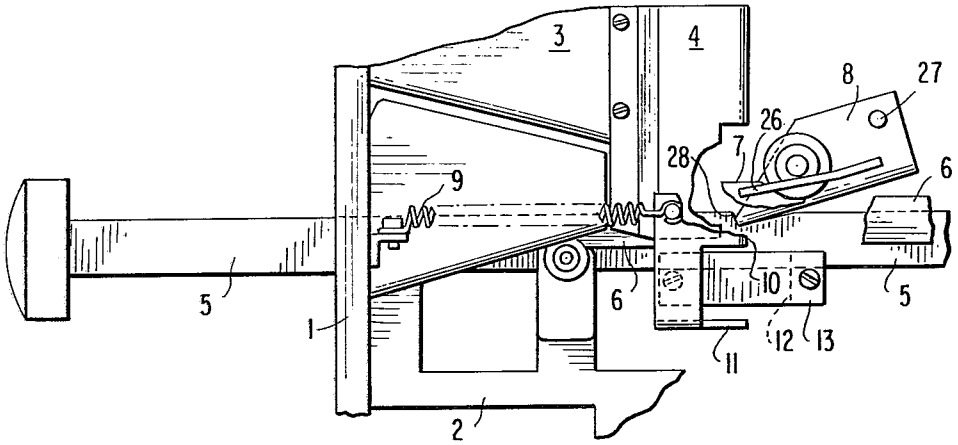
FIG. 6 is a fragmentary side elevation view with parts removed showing the locking pawl.
Figure 7:
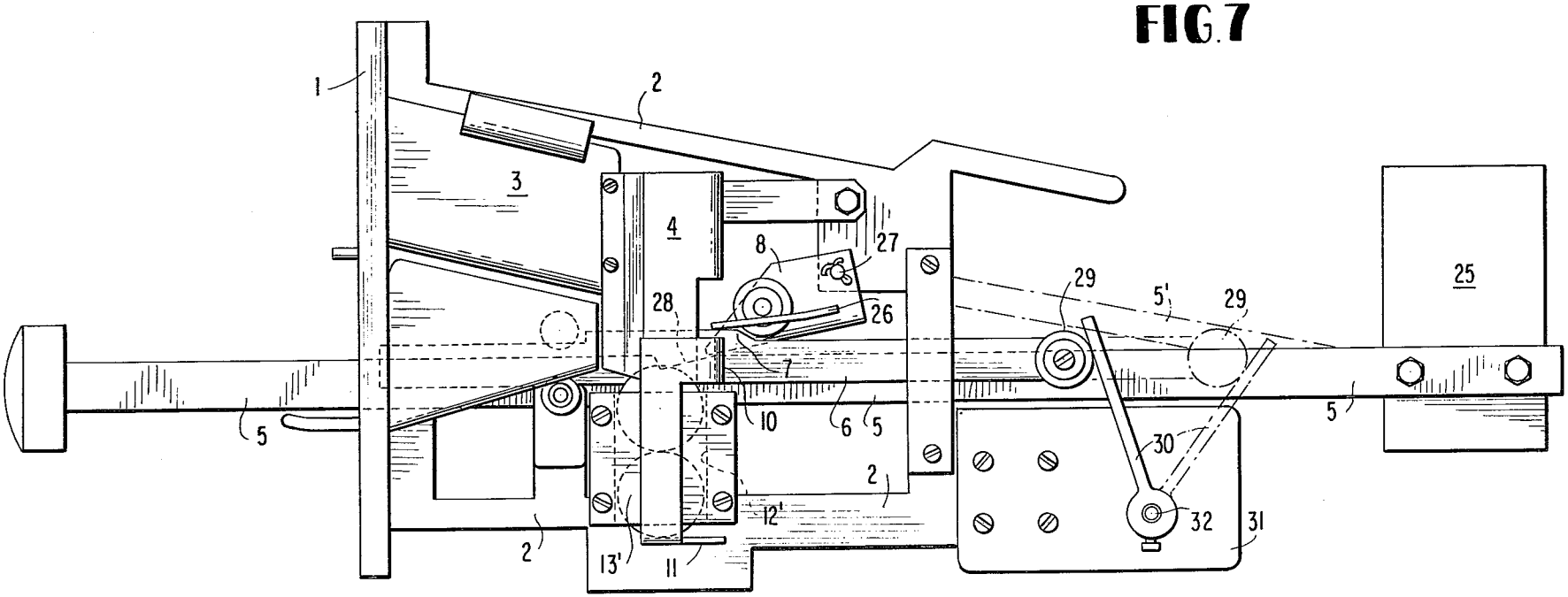
FIG. 7 is a side elevation view showing a modified form of the invention.

To prevent a coin inserted for fresh playing time from falling through the coin shafts 4 and 12 into the coin collection box beneath coin slot 12 when the parts are in the position represented in FIGS. 4 and 5, without bringing the second rod 6 back into the position illustrated in FIGS. 1, 6 and 7, at the beginning of the playing time, the locking pawl 8 is equipped with an additional lateral blocking element 26, which, when the parts are in the position indicated in FIGS. 4 and 5, protudes into the coin shaft 4 into the path of any coins passing there through, thereby preventing the coins from ineffectually falling down through the controller. The new coin is retained in coin shaft 4 by the blocking element 26, as illustrated, and only released when the cam portion 7 of the second rod 6 allows the locking pawl 8 to fall downwards about its pivot point 27 at the end of the playing time. In the course thereof, the blocking element 26 is also pivoted out of the coin shaft 4, as shown in FIGS. 1, 6 and 7, and the freshly inserted coin can fall freely through the coin shaft 4. At this monent the lateral projection 11 is again located beneath the coin shaft 12 to retain the new coin therein such that the upper end of the newly inserted coin projects into the U-shaped yoke 10 of the second rod 6, as in the case of the first coin insertion, and when the release rod 5 is again actuated by pushing it inwardly it moves the second rod 6 into the illustrated starting position of FIG. 4 at the beginning of the playing time.

Referring to FIG. 6, when there is no coin in the coin slot 12 and the release rod 5 is pushed inwardly, the pawl 8, under the biasing force of its spring 8 prime, slides into engagement with locking notch 28 in the top of release rod 5 and prevents further inward movement of release rod 5. When a coin is present in slot 12, it moves cam portion 7 of second rod 6 into engagement with the pawl 8 to cause lifting of the pawl before it moves into an engagement with the locking notch 28.

A modified form of the coin release device of the invention is shown in FIG. 7 in which two coins are required in slot 12 prime of coin retainer shaft 13 prime before the second rod 6 can be moved to lift the blocking pawl to allow the release rod 5 to be pushed inwardly to actuate the game device. In this form of the invention, instead of a rack gear 14 on the inner end of second rod 6, a roller bearing 29, or some other appropriate means is provided for engagement with lever arm 30 of the spring actuated timing mechanism 31 connected to frame 2. Timing mechanism 31 is of a well known type whereby inward movement of second rod 6 causes the roller bearing 29 thereon to rotate lever arm 30 clockwise about its axis of rotation 32 to the dotted line position, at which point the axis of rotation 32 has round the spring of a timing mechanism within the case 31. When rod 5 is released and it is returned to the outer position as shown in FIG. 5 by the return spring 9, the coins drop from slot 12 prime into a collection box, not shown, and the spring within the timing mechanism 31 together with the gearing therein, caused the lever arm 30 to slowly rotate counter clockwise and push second rod 6 through roller bearing 29, from the dotted line position to the full line position. At this point, further inward movement of release rod 5 is blocked because pawl 8 will move into locking notch 28 as rod 5 is moved slightly inwardly. The timing mechanism 31 is a retarding mechanism in which the internal spring can be strong enough so that it can move second rod 6 from right to left through lever arm 30 without any additional spring, such as return spring 9 shown in FIGS. 1–6. If the internal spring of the timing mechanism is not strong enough to allow lever arm 30 to push second rod 6 through its return stroke, a return spring can be connected between the outer free end of lever arm 30 and frame 2 of the coin controller.

The new type of coin release device is advantageously used in combination with a conventional coin release device and thus it is possible for both game forms to be played on the same unit.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A coin controller device for vending machines comprising a housing, a release rod mounted for longitudinal displacement in said housing, locking pawl means connected to lockingly engage said release rod to normally lock it from longitudinal displacement, a second rod mounted in said housing for independent longitudinal displacement adjacent said release rod, receiver means on said release rod adapted to receive a coin, retainer means connected to said second rod to retain a coin in said receiver means, engaging means connected on said second rod in the path of movement of the upwardly projecting portion of a coin in said receiver means and adapted to engage said coin whereby longitudinal movement of said release rod is also imparted to said second rod, a cam on said second rod connected for moving said locking pawl means out of locking engagement with said release rod on simultaneous movement of said release rod and second rod, return spring means connected to said first rod, and a time delay mechanism operatively connected to control the return movement of said second rod.

2. A coin controller device as set forth in claim 1 in which said receiver means comprises a lateral projection on said release rod and includes a through-slot for coins.

3. A coin controller device as set forth in claim 2 in which said retainer means comprises a lateral member positioned beneath the through-slot of said lateral projection to retain a coin therein.

4. A coin controller device as set forth in claim 2 in which said engaging means comprises a U-shaped yoke.

5. A coin controller device as set forth in claim 4 in which said U-shaped yoke is positioned horizontally above said lateral projection to enclose the top portion of a coin in and extending above said lateral projection.

6. A coin controller device as set forth in claim 4 in which said retainer means comprises a lateral member connected to said U-shaped yoke and positioned beneath the through-slot of said lateral projection.

7. A coin controlled device as set forth in claim 1 in which said cam having a beveled edge portion connected to raise said locking pawl means from a position blocking longitudinal movement of said release rod to a position unblocking such longitudinal movement, and having a retainer portion for holding said locking pawl means in the raised position during movement of said second rod.

8. A coin controller device as set forth in claim 1 in which said time delay mechanism includes a toothed rack gear connected to said second rod.

9. A coin controller device as set forth in claim 1 in which said time delay mechanism comprises a step-up gear train, and a pendulum of variable length driven by said gear train.

10. A coin controller device as set forth in claim 1 including a coin shaft connected in said housing in alignment with said receiver means, and a blocking member mounted on said locking pawl means for movement into a position blocking said coin shaft in the unlocked position of said locking pawl means.

11. A coin controller device as set forth in claim 1 in which said time delay mechanism includes a lever arm connected for movement by a spring wound type timing device, and said lever arm moveably connected to said second rod to move it in a return direction.

* * * * *